US011234483B2

(12) United States Patent
Leatt et al.

(10) Patent No.: US 11,234,483 B2
(45) Date of Patent: Feb. 1, 2022

(54) FOOTWEAR ARTICLE WITH LOCKABLE ANKLE PROTECTION

(71) Applicant: LEATT CORPORATION, Santa Clarita, CA (US)

(72) Inventors: Christopher James Leatt, Durbanville (ZA); Carel Sias Meyer, Durbanville (ZA); Cornelis Uys De Jongh, Durbanville (ZA); Jörn Peter Steffens, Oldenburg (DE)

(73) Assignee: LEATT CORPORATION, Santa Clarita, CA (US)

( * ) Notice: Subject to any disclaimer, the term of this patent is extended or adjusted under 35 U.S.C. 154(b) by 0 days.

(21) Appl. No.: 16/064,914

(22) PCT Filed: Dec. 21, 2016

(86) PCT No.: PCT/IB2016/057895
§ 371 (c)(1),
(2) Date: Jun. 21, 2018

(87) PCT Pub. No.: WO2017/109732
PCT Pub. Date: Jun. 29, 2017

(65) Prior Publication Data

US 2018/0368513 A1 Dec. 27, 2018

(30) Foreign Application Priority Data

Dec. 22, 2015 (GB) ..... 1522642

(51) Int. Cl.
*A43B 7/20* (2006.01)
*A43B 5/14* (2006.01)
(Continued)

(52) U.S. Cl.
CPC ..... *A43B 7/20* (2013.01); *A43B 5/0474* (2013.01); *A43B 5/145* (2013.01); *A43C 11/1473* (2013.01); *A43B 5/0419* (2013.01)

(58) Field of Classification Search
CPC ..... A43B 7/20; A43B 5/0474; A43B 5/145; A43B 5/0419; A43B 5/0456;
(Continued)

(56) References Cited

U.S. PATENT DOCUMENTS 5,560,128 A * 10/1996 Marega ..... A43B 5/0474 36/118.2
6,021,589 A * 2/2000 Cagliari ..... A43B 5/04 36/117.1
(Continued)

FOREIGN PATENT DOCUMENTS

EP 2201853 6/2010
EP 2885993 A1 * 6/2015
WO WO-0135781 5/2001

OTHER PUBLICATIONS

International Search Report for PCT/IB2016/057895, dated Apr. 11, 2017.
(Continued)

*Primary Examiner* — Khoa D Huynh
*Assistant Examiner* — Aiying Zhao
(74) *Attorney, Agent, or Firm* — B. Aaron Schulman, Esq.; Stites & Harbison, PLLC

(57) ABSTRACT

An item of footwear such as a boot (10) includes a stiff lower part (12) that extends around part of a wearer's foot, a stiff upper part (16) that extends around the wearer's lower leg, and one or more limit elements (66,72,80,88) that extend between the lower part (12) and the upper part (16). The lower part (12) and upper part (16) are movable relative to each other when the ankle moves and the relative movement is inhibited selectively by the limit elements (66,72,80,88).
(Continued)

The limit elements (66,72,80,88) are displaceable between a free condition in which the lower part (12) and the upper part (16) are movable relative to each other, and lock condition in which the relative movement between the lower part (12) and the upper part (16) is inhibited.

11 Claims, 9 Drawing Sheets

(51) Int. Cl.
*A43B 5/04* (2006.01)
*A43C 11/14* (2006.01)

(58) Field of Classification Search
CPC . A43B 5/0439; A43B 5/0452; A43C 11/1473; A43C 11/12
USPC ..... 36/89, 109, 118.2, 118.3, 118.7, 118.1
See application file for complete search history.

(56) References Cited

U.S. PATENT DOCUMENTS

| | | | | |
|---|---|---|---|---|
| 2005/0217151 | A1* | 10/2005 | Valat | A43B 5/145 36/117.5 |
| 2006/0168849 | A1 | 8/2006 | Valat et al. | |
| 2011/0088283 | A1 | 4/2011 | Berthet et al. | |
| 2015/0359292 | A1* | 12/2015 | Chaigne | A43B 5/0466 36/118.4 |

OTHER PUBLICATIONS

Written Opinion of the International Searching Authority for PCT/IB2016/057895, dated Apr. 11, 2017.

* cited by examiner

FOOTWEAR ARTICLE WITH LOCKABLE ANKLE PROTECTION

FIELD OF THE INVENTION

This invention relates to footwear that reduces the risk and/or severity of ankle injury, yet allows adequate freedom of movement for activities such as motorcycling, which require ankle movement and pose risk of injury.

BACKGROUND TO THE INVENTION

Various means have been devised to ameliorate ankle injuries by restricting or preventing unwanted ankle movement in some way or other and in many situations, these restrictions are acceptable, e.g. during recovery from injury, or in activities where little or no ankle movement is required. However, in many activities, there is simultaneously a need for ankle movement and a risk of ankle injury that warrants protection. One such activity is motorcycling, in which a rider needs to operate controls (the gear selector and brake) with his feet and frequently need to move his lower legs and feet as part of riding. Motorcycling is used herein as an example of an activity for which the present invention holds particular advantage, but the invention can be applied in various other activities and is by no means limited to motorcycling.

Footwear (boots) for motorcycling have been adapted in various ways to protect ankles against injury and this has predominantly been done by guiding ankle movement, by stabilising the ankle (damping or preventing ankle movement), or a combination of these.

Guiding ankle movement typically restricts ankle movement that is not generally required for riding and that pose an injury risk, e.g. a boot may include guides or hinges that restrict eversion and inversion of the foot, without inhibiting dorsi and plantar flexion of the foot significantly. Even though it may appear that ankle movements in some directions are not essential, restricting these movements inhibit general foot and ankle movement and proprioception.

Stabilising the ankle is typically done by providing a boot that is generally stiff, inhibiting movement to an extent, but still allowing sufficient movement to operate controls. While wearing stiff boots that damp ankle movement tends to create an impression of safety, it often provides less protection than expected, while severely inhibiting ankle mobility.

The present invention seeks to provide protection against ankle injury during active ankle use, without undue restriction on ankle mobility.

SUMMARY OF THE INVENTION

According to the present invention there is provided an item of footwear comprising:

- a stiff lower part that is configured to extend at least in part around the foot of a wearer, below (i.e. plantar of) the ankle joint;
- a stiff upper part that is configured to extend at least in part around the lower leg of the wearer, above the ankle joint; and
- at least one limit element that is extends between the lower part and the upper part;
- wherein the lower part and the upper part are movable relative to each other, with said relative movement being inhibited selectively by the limit element, the limit element being displaceable between a free condition in which the lower part and the upper part are movable relative to each other, and lock condition in which the relative movement between the lower part and the upper part is inhibited in at least one direction, the direction in which the limit element is displaced from its free condition to its lock condition corresponding to the direction in which relative movement between the lower part and the upper part is inhibited.

The term "ankle joint" is intended to refer to the true ankle joint and not to include the subtalar joint, for purposes of describing the positions of the upper part and lower part. However, references to "ankle" and "ankle injury" is not limited to the true ankle joint and refers to the ankle, generally.

One or more of the limit elements may include at least one flexible tensile element, said tensile element being slack in its free condition when the wearer's ankle is in a neutral condition, and said tensile element becoming taut in its lock condition when the wearer's ankle is moved from the neutral condition to a predetermined extent.

Instead, or in addition, one or more of the limit elements may be rigid and may be attachable in at least one location to the upper part or the lower part with an attachment element, with play between the limit element and the attachment element when the ankle is in a neutral condition and the limit element is in its free condition, said play being taken up and the limit element being in a lock condition when the wearer's ankle is moved from the neutral condition to a predetermined extent.

The limit element may be attachable to the upper part in a tight manner and may be attachable to the lower part with the attachment element and the limit element may extend between a lateral attachment on the upper part to a posterior attachment on the lower part, or between a posterior attachment on the upper part to a posterior attachment on the lower part.

The item of footwear may include a flexible part extending between the lower part and the upper part.

BRIEF DESCRIPTION OF THE DRAWINGS

For a better understanding of the present invention, and to show how it may be put into effect, the invention will now be described by way of non-limiting example, with reference to the accompanying drawings in which.

DETAILED DESCRIPTION OF THE DRAWINGS

Figure 1:
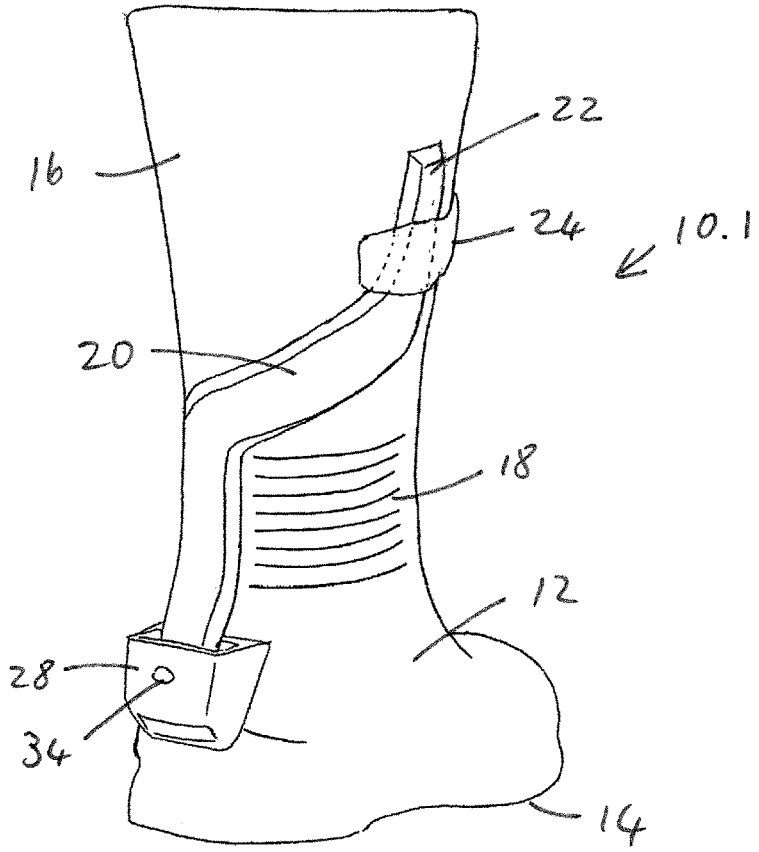
FIG. 1 shows a diagrammatic rear three-dimensional view of a first embodiment of a boot according to the present invention.
Figure 2:
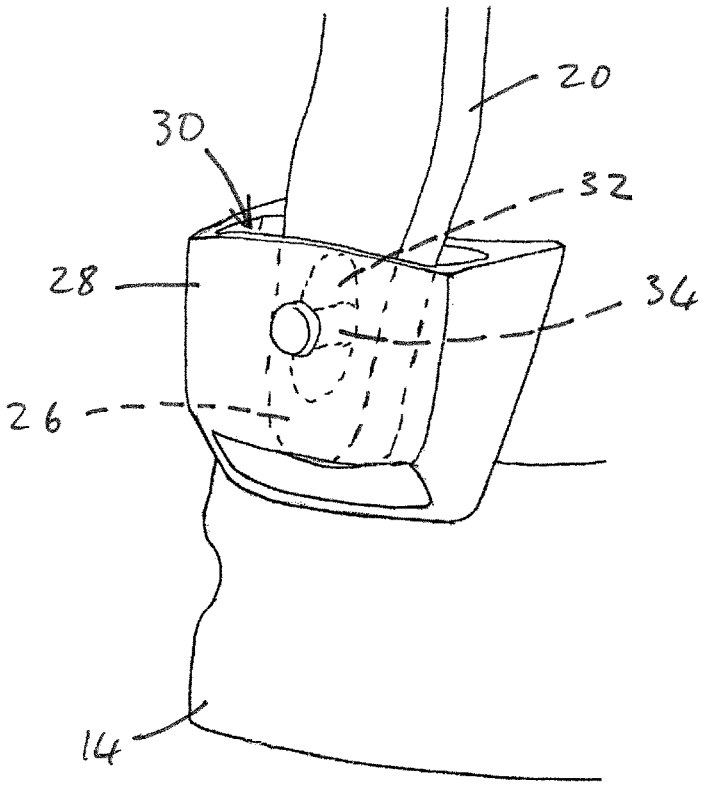
FIG. 2 shows a diagrammatic detail rear three-dimensional view of a heel of the boot of FIG. 1.
Figure 3:
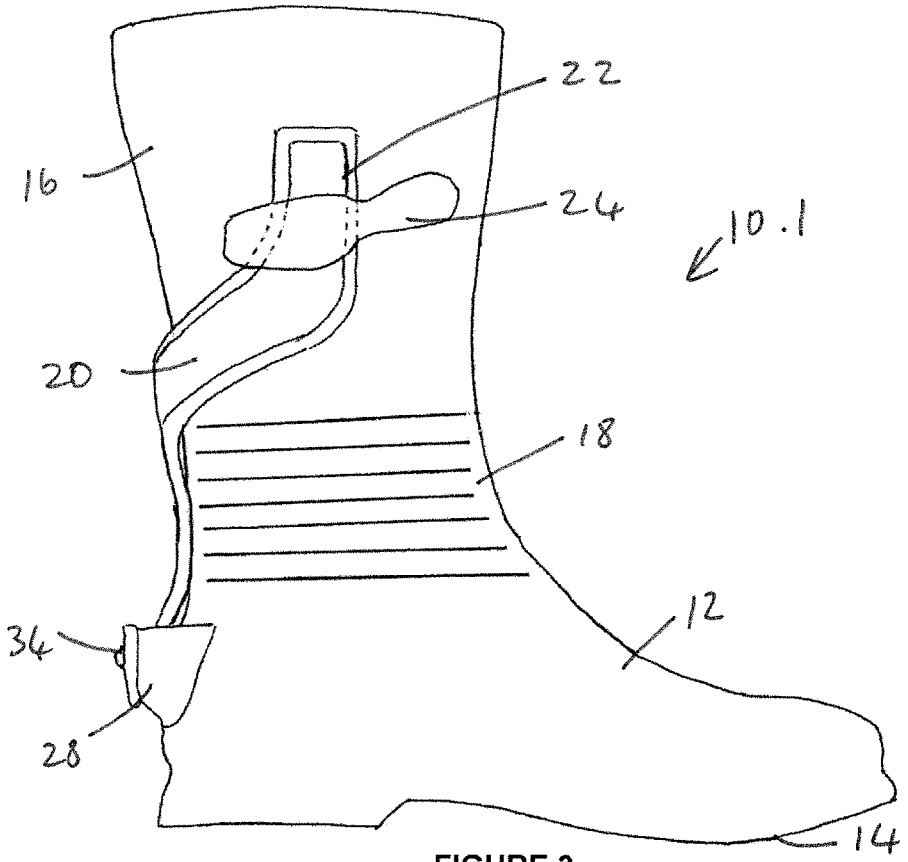
FIG. 3 shows a diagrammatic side view of the boot of FIG. 1.

Referring to the drawings, an item of footwear according to the present invention in the form of a boot, is generally identified by reference number 10, but the reference number 10 is supplemented with suffixes to identify different embodiment of the boot. The boots 10 shown in the drawings are for the right foot, but the invention applies equally to footwear for either foot.

Referring to FIGS. 1, 2, 3, 5 and 10 to 15, the boot 10 includes a lower part 12 that extends around the foot, below the ankle. The lower part 12 typically includes a sole 14 and can include many variations, but preferably, the lower part fits reasonably tightly around the heel. The boot also includes an upper part 16 that extends around part of the lower leg, above the ankle, and that preferably fits around the lower leg reasonably tightly. The lower and upper parts 12,16 are preferably reasonably stiff or include parts that are reasonably stiff, e.g. these parts may be rigid or semi-rigid, may comprise substantial parts that are rigid or semi-rigid, or the like. The upper part could comprise a unitary stiff element that extends around the lower leg, or if could comprise a stiff part that is held reasonably tightly in position relative to the lower leg by other parts.

In some of the drawings, the lower and upper parts 12,16 are shown very plainly, merely as diagrammatic representations, but these parts preferably include features that are common for sports footwear, such as ventilation features, impact protective elements tightening features, and the like.

Between the lower and upper parts 12,16, the boot includes a flexible part 18 that extends around the ankle and is shown in the drawings as a series of parallel lines or ribs. The nature and position of the flexible part 18 can vary, and this part preferably has little or no impact on ankle mobility, despite the relative stiffness of the lower part 12 and upper part 16, adjacent to it. By way of example, in other embodiments of the invention, the flexible part may simply be parts of the boot made from conventional materials such as fabric or leather, which are sufficiently flexible. The flexible part may also comprise a small portion of the boot or it may comprise a larger portion, as long as it provides sufficient flexibility between the upper and lower parts 12,16.

Referring to FIGS. 1 to 4, a first embodiment of the boot 10.1 includes a limit element in the form of a rigid, curved arm 20. An upper end 22 of the arm 20 is tightly attachable to the upper part 16 in a lateral position by way of a clasp 24 (shown only in outline in the drawings), although the arm can be attached to the upper part in a variety of ways. The arm 20 curves around the upper leg and extends in a distal direction behind (posterior to) the ankle to a lower end 26 of the arm at the posterior of the heel.

The lower end 26 is attached to the posterior of the lower part 12 by way of an attachment element 28 that is fixed on the heel of the lower part. The attachment element 28 defines an internal cavity 30 that is open at its top and bottom and the lower end 26 fits inside the cavity with play, so that the lower end 26 can move around in the cavity in all directions. An elongate aperture 32 is defined in the lower end 26 and an anchor pin 34 of the attachment element 28 extends across the cavity 30 and through the aperture 32, to hold the lower end captive in the cavity.

Figure 4A:
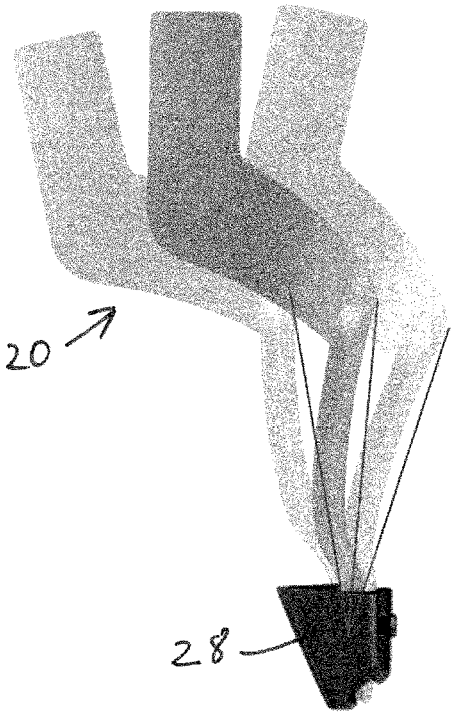
FIGS. 4A and 4B show a side view and rear view, respectively, of a protection mechanism of the boot of FIG. 1, in normal and flexed positions.

As shown in FIG. 4A, the arm 20 can tilt backwards and forwards relative to the attachment formation, while the lower end 26 remains inside the cavity 30. When the arm 20 is in a free position, shown in FIG. 4A as the middle position of the arm, there is ample play between the lower end 26 and the inside of the cavity 30 and there is ample play between the anchor pin 34 and the aperture 32. The play allows the arm 20 to tilt backwards and forward without resistance, but when the play has been taken up, the lower end 26 pushes against the inside of the cavity 30 and/or the anchor pin 34 pushes against the aperture 32 to prevent further tilting of the arm, when the arm has reached the limit of its tilting motion and is in a lock condition.

Figure 4B:
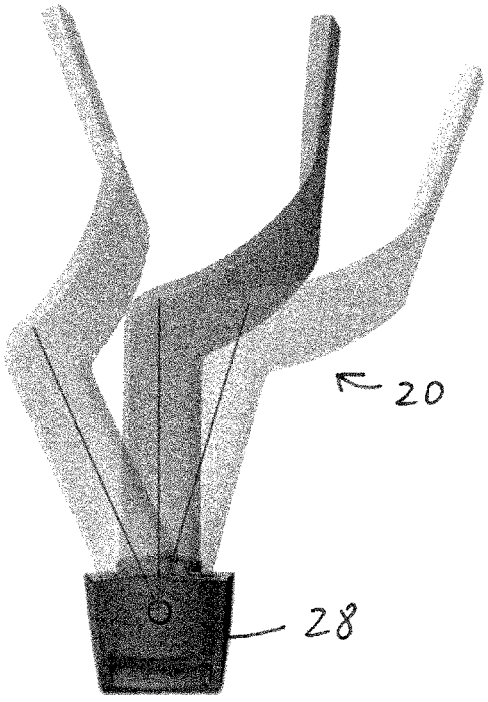

Similarly, as shown in FIG. 4B, the arm 20 can tilt sideways to either side from a central, free position, without resistance, until play is taken up and further tilting of the arm is prevented by mechanical interaction between the lower end 26 and cavity 30 and/or between the aperture 32 and anchor pin 34, when the arm has reached the limit of its tilting motion and is in a lock condition.

In use, when the ankle is in a neutral condition, i.e. if the wearer's foot is not flexed, tilted, rotated or the like, the arm 20 is in its free condition with ample play between the lower end 26 and the attachment element 28. The wearer can move his ankle without resistance from the arm 20 and owing to the flexible part 18, there is very little resistance to ankle mobility. This allows the wearer freedom of ankle movement in many directions, allows proprioception, and the like.

If the ankle moves, whether through dorsi or plantar flexion, inversion, eversion, rotation, or any other movement, the ankle movement will cause the lower part 12 to move with the wearer's foot and the upper part 16 to move with the wearer's lower leg, so that there is relative movement between the lower and upper parts 12,16 in a movement direction. If the ankle movement in the movement direction continues to a predetermined degree, beyond which there is an increased risk of injury, the play between the lower end 26 and attachment element 28 is taken up and the arm 20 reaches its lock condition, in which it prevents further movement between the attachment formation and the arm, which translates to prevention of movement between the lower and upper parts 12,16 and thus prevention of further ankle movement in the movement direction.

The play between the lower end 26 and the attachment element 28 is configured so that the movement allowed between these parts, while the arm 20 is in its free condition, allows the wearer comfortable ankle mobility for normal ankle use. The play is only take up, the arm reaches its lock condition and further ankle movement is prevented, when further ankle movement would be likely to cause injury.

Figure 5:
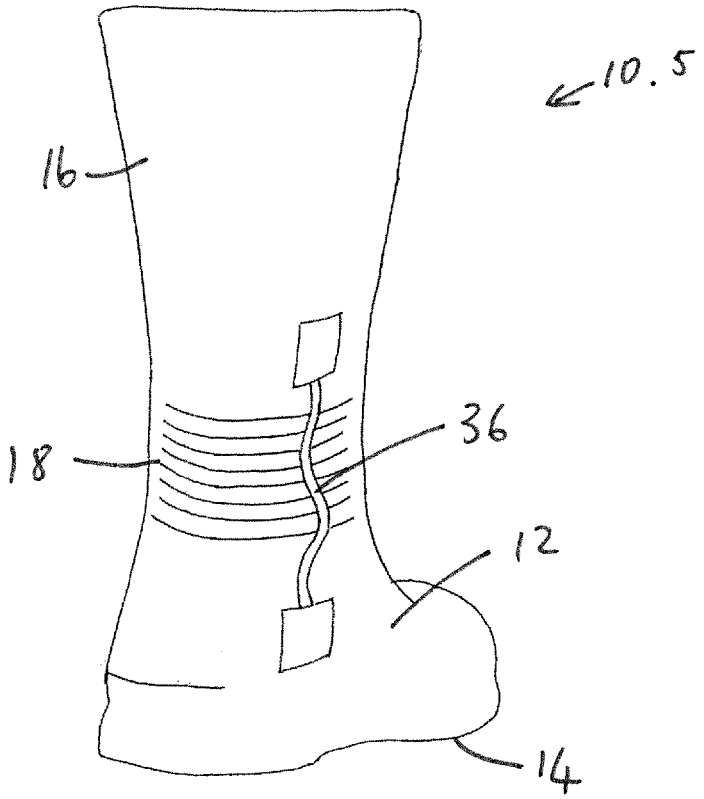
FIG. 5 shows a diagrammatic rear three-dimensional view of a second embodiment of a boot according to the present invention.

Referring to FIG. 5, a second embodiment of the boot 10.2 includes a limit element in the form of a flexible tensile element in the form of a tether 36 that is fixedly attached to the lower part 12. The tether 36 is slack in its free condition when the wearer's ankle is in a neutral condition, as shown in FIG. 5. This is the condition of the tether 36 during normal use of the boot 10.2 and the tether has practically no inhibiting effect on ankle movement.

However, if the ankle moves in an inversion to a predetermined extent, the lower and upper parts 12,16 move relative to each other until the tether 36 becomes taut in a limit condition of the tether and resists further relative movement between the lower and upper parts in the same direction—thus preventing further ankle inversion beyond a predetermined angle of inversion.

Only one tether 36 is shown in FIG. 5, on a lateral side of the ankle, but more tethers can be used and they can extend in different positions around the ankle and in different angular directions and can target different ankle movements, e.g. diagonal tethers can be used to limit internal/external rotation.

Referring to FIGS. 6 to 9, a lower leg, ankle and foot of an anthropomorphic test device (test dummy) was fitted inside a conventional motorcycling boot (Alpinestars Tech10) to serve as standard and was fitted inside each of the two embodiments described above. The standard boot is identified in the experimental results as "Tech10" and is also marked with reference "A", for clarity; the first embodiment of the present invention (shown in FIGS. 1 to 4) is identified as "Leatt C-Arm" and is marked with reference "B"; and the second embodiment of the present invention (shown in FIG. 5) is identified as "Leatt Cable" and is marked with reference "C".

Experiment 1

Figure 6A:
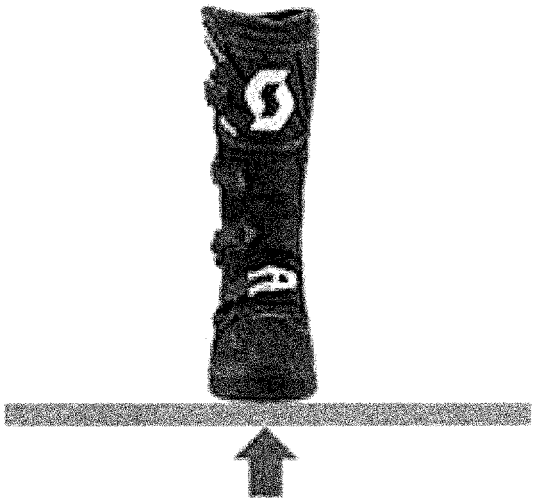
FIGS. 6A and 6B show front views of boots being tested with upward impact applied on the soles of the boots from a flat surface and from a lateral step, respectively.
Figure 7:
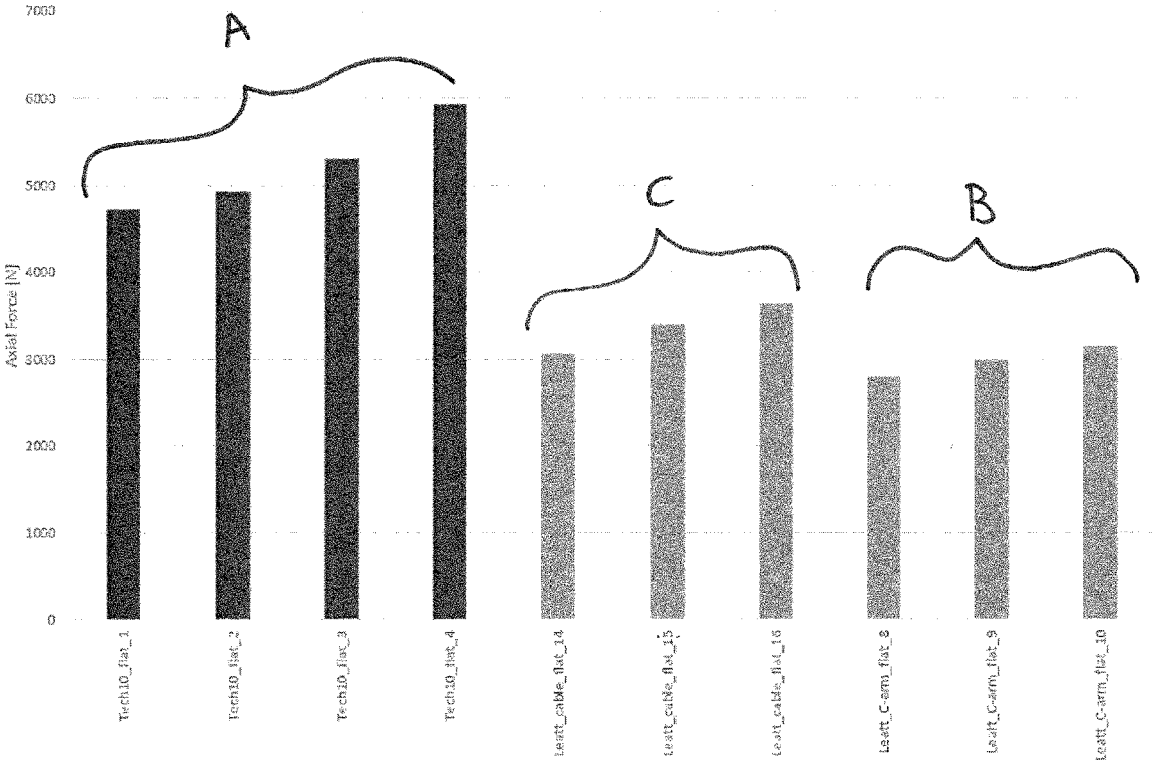
FIG. 7 shows experimental results of ankle axial forces in a lower leg with the foot shod in different boots, with upward impact applied on the soles of the boots from a flat surface.

Each of the boots was supported on a flat surface and received a 6000N impact from below, as shown in FIG. 6A and the axial force in the ankle of the test device was recorded for each repetition of each test. The results are shown in FIG. 7, in which the first four test results are for the standard motorcycling boot (Tech10), the next three test results are for the second embodiment of the present invention (Leatt Cable) and the last three test results are for the first embodiment of the present invention (Leatt C-Arm).

Experiment 2

Figure 6B:
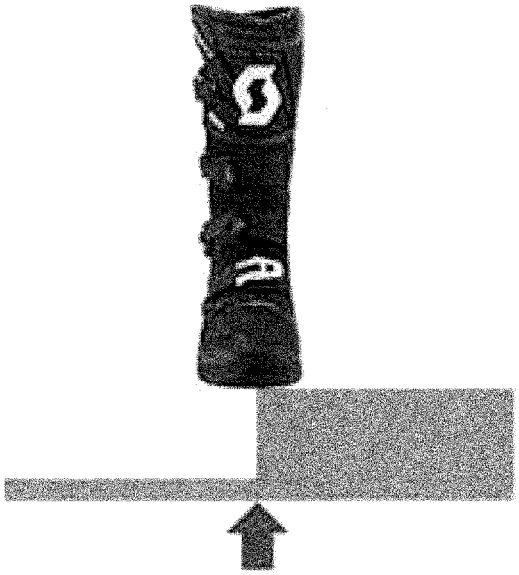
Figure 8:
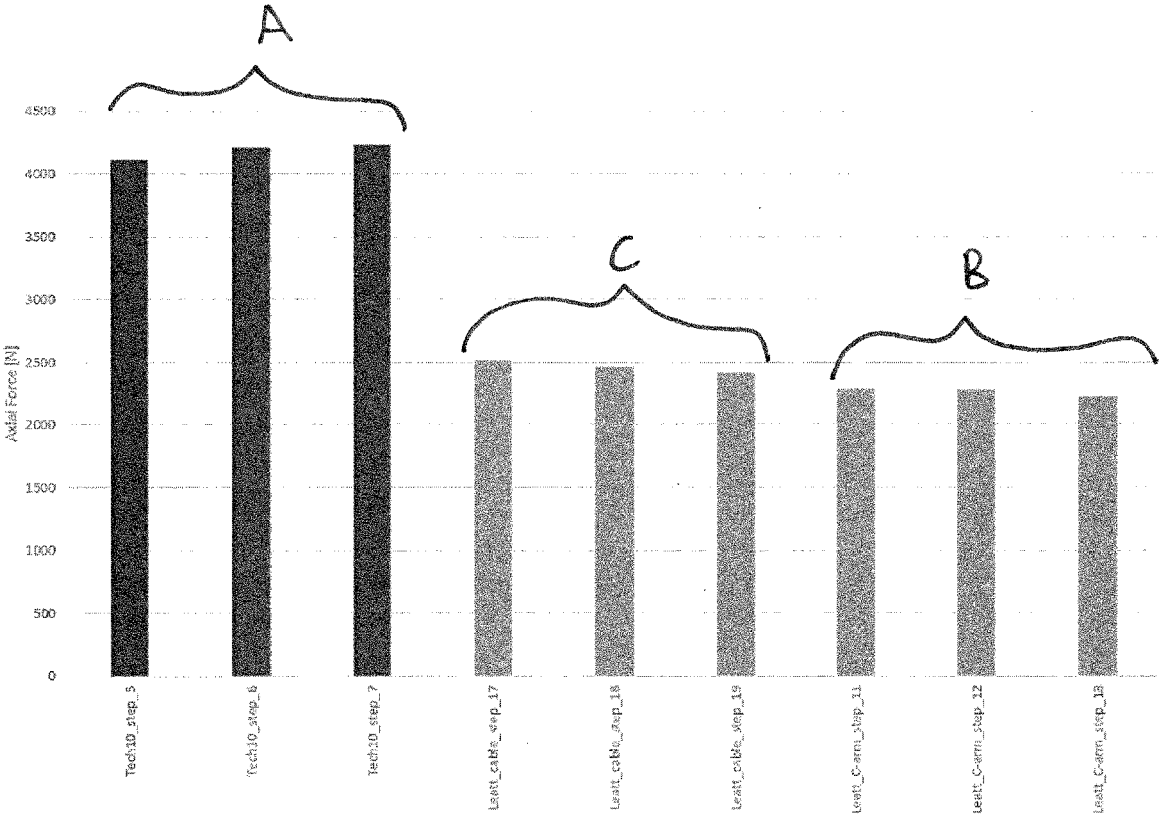
FIG. 8 shows experimental results of ankle axial forces in a lower leg with the foot shod in different boots, with upward impact applied on the soles of the boots from a lateral step.
Figure 9:
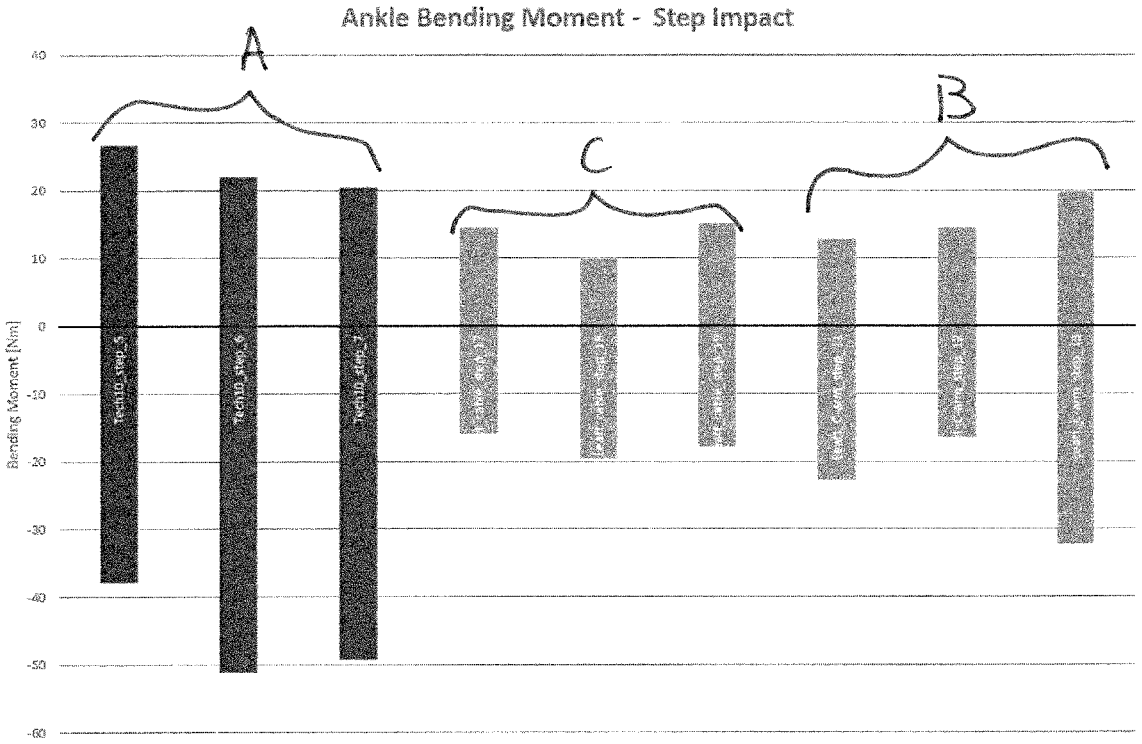
FIG. 9 shows experimental results of ankle bending moments in a lower leg with the foot shod in different boots, with upward impact applied on the soles of the boots from a lateral step.

Each of the boots was supported on a surface with a lateral step and received a 6000N impact from below, as shown in FIG. 6B and the axial force and the bending moment in the ankle of the test device, were recorded for each repetition of the test. The results are shown in FIGS. 8 and 9, in each of which the first three results are for the standard motorcycling boot (Tech10), the next three results are for the second embodiment of the present invention (Leatt Cable) and the last three results are for the first embodiment of the present invention (Leatt C-Arm).

The test results are summarised in the table below:

| | Alpinestars Tech10 | | Leatt Cable | | Leatt C-Arm | |
|---|---|---|---|---|---|---|
| | Avg axial force [N] | Avg bending moment [Nm] | Avg axial force [N] | Avg bending moment [Nm] | Avg axial force [N] | Avg bending moment [Nm] |
| Injury Threshold (IARV) | 5500 | 16 | 5500 | 16 | 5500 | 16 |
| Flat impact - 6000N baseline | 5488 | | 3400 | | 2983 | |
| Stepped impact - 6000N baseline | 4183 | 46 | 2453 | 18 | 2270 | 24 |

The test results show that both embodiments of the present invention performed notably better than the standard, especially in Experiment 2 (the stepped test), where the ankle was forced into inversion.

Conventional ankle prevention technique requires that the ankle be stabilised, i.e. its mobility restricted, in order to protect it against injury—with concomitant restrictions in movement, as mentioned above. However, the test results above indicate that freeing up the ankle and limiting only excessive ankle movement provides better protection against injury, without significant limitations on ankle mobility.

Figure 10:
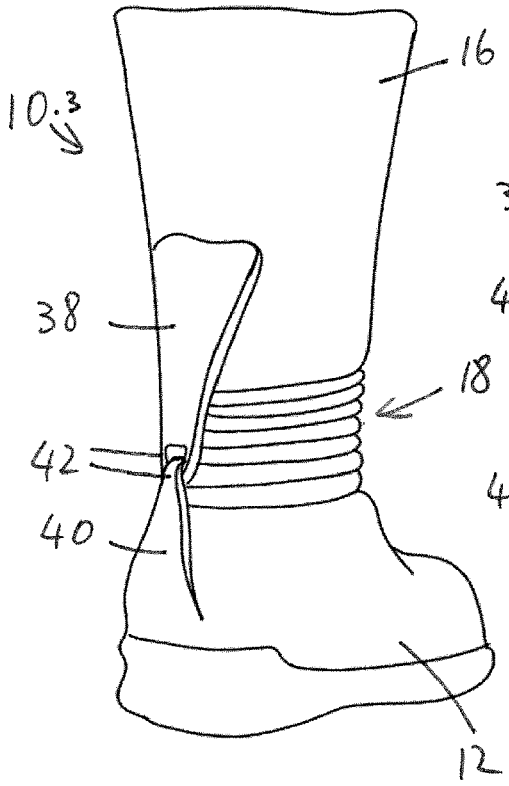
FIG. 10 shows a diagrammatic rear three-dimensional view of a third embodiment of a boot according to the present invention.
Figure 11:
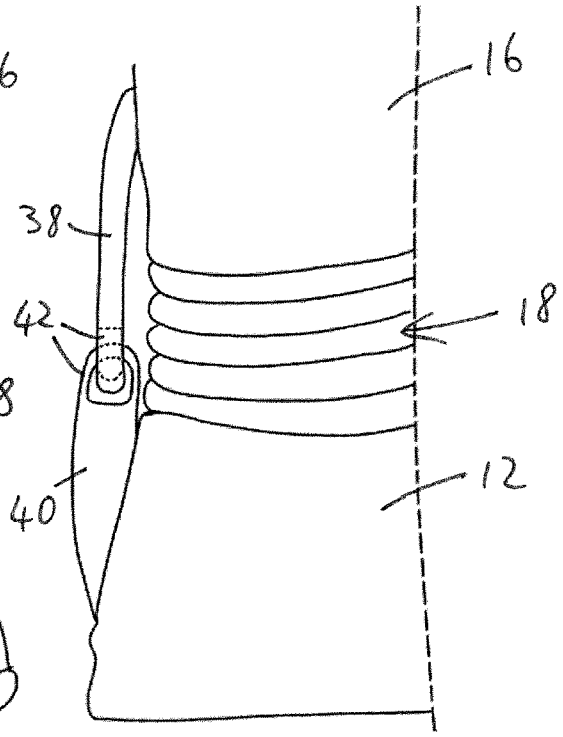
FIG. 11 shows a detail side view of a protection mechanism of the boot of FIG. 10.

Referring to FIGS. 10 and 11, a third embodiment of the boot 10.3 is similar in operation to the first embodiment shown in FIGS. 1 to 4 and includes a limit element in the form of a rigid upper element 38 that extends downwards from a posterior attachment to the upper part 16 of the boot and a lower element 40 that extends upwards from a posterior attachment to the heel of the boot. The upper and lower elements 40 are joined with interlocking features with play between them and in the illustrated embodiment, the interlocking features are in the form of loop formations 42 formed in each of the upper and lower elements.

The loop formations 42 in the example are oriented perpendicularly to each other and have sufficient play between them when in a free condition, to allow the loop formations and thus the upper and lower elements 38,40 and the upper and lower parts 16,12 of the boot 10.3 to move relative to each other, so that the upper and lower parts of the boot can flex about the flexible part 18, during normal use, without resistance. However, when the play has been taken up, the loop formations 42 push or pull against each other to prevent further tilting when the upper and lower elements 40,42 are in a lock condition.

Figure 12:
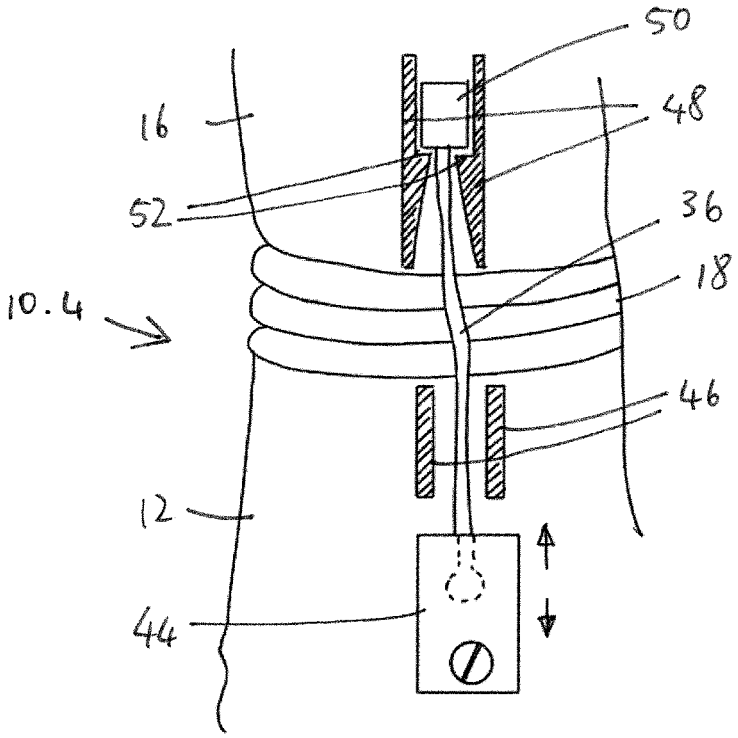
FIG. 12 shows a diagrammatic side view of a protection mechanism of a fourth embodiment of a boot according to the present invention.

Referring to FIG. 12, a fourth embodiment of the boot 10.4 is similar in operation to the second embodiment shown in FIG. 5 and includes a tether 36 that extends between the lower part 12 and upper part 16, that is slack in its free condition and taut in its lock condition.

The tether 36 is fixedly attached to the lower part 12 in an anchor element 44 and the tether extends inside two housings or guides with play—a lower guide 46 that is attached to the lower part 12, and an upper guide 48 that is attached to the upper part 16. An upper end of the tether 36 includes a stopper 50 and the upper guide 48 includes internal shoulders 52 that prevent the stopper from being pulled downwards beyond the point where the stopper makes contact with the shoulders.

In use, when the tether 36 is slack in its free condition, the tether can flex and/or the stopper 50 can be raised off the shoulders 52 during ankle movement, but if the ankle movement exceeds a predetermined limit, the tether becomes taut and pulls the stopper onto the shoulders, to prevent the tether from sliding further relative to the upper guide.

The fixed attachment of the lower end of the tether 36 in the anchor element 44 can be adjusted upwards and downwards, as shown by arrows in FIG. 12, to adjust the extend of ankle movement that will be permitted before the tether becomes taut.

Figure 13:
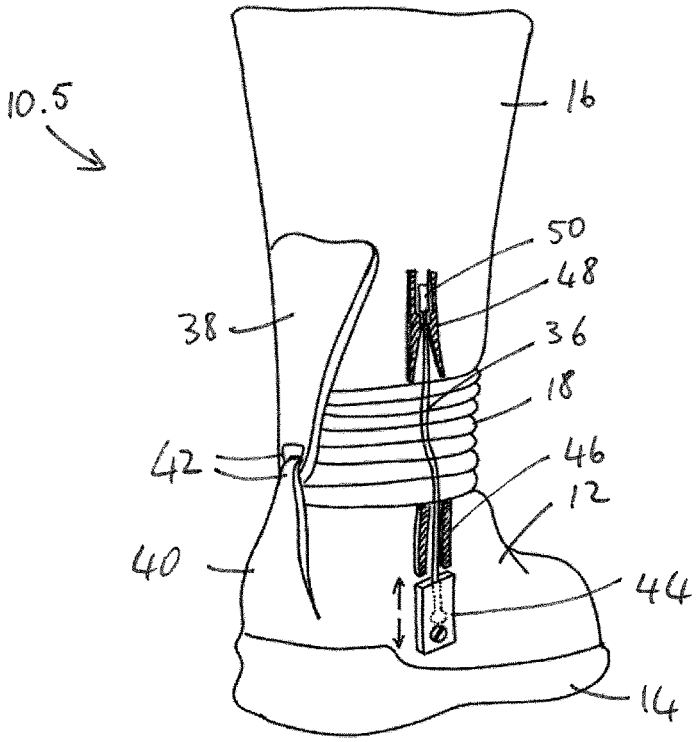
FIG. 13 shows a diagrammatic rear three-dimensional view of a fifth embodiment of a boot according to the present invention.

FIG. 13 shows a fifth embodiment of the boot 10.5, including the protection mechanisms of FIGS. 10, 11 and 12, in combination.

In another embodiment of the invention (that is not illustrated), two interlocking elements in the form of loops or U-shaped elements are attached to the upper part 16 and lower part 12, respectively, with play between the interlocking elements in their free condition, to allow full ankle motion without significant restriction. Said play being taken up in the event of predetermined tension, compression or rotation between the elements, when the elements are in a lockout condition, after a predetermined extent of ankle movement has taken place.

Figure 14:
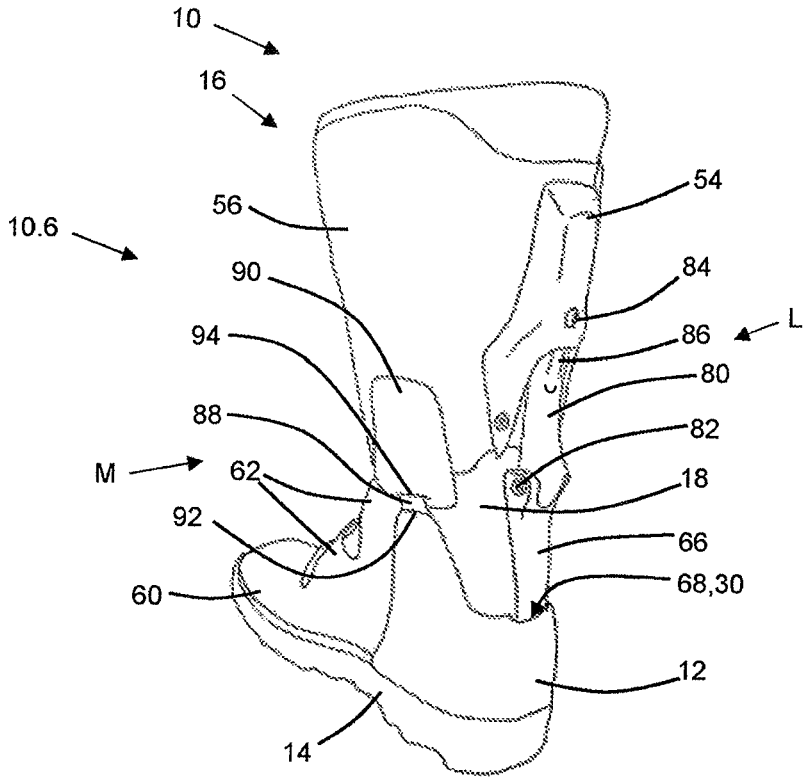
FIG. 14 shows a diagrammatic medial rear three-dimensional view from above, of a sixth embodiment of a boot according to the present invention.
Figure 15:
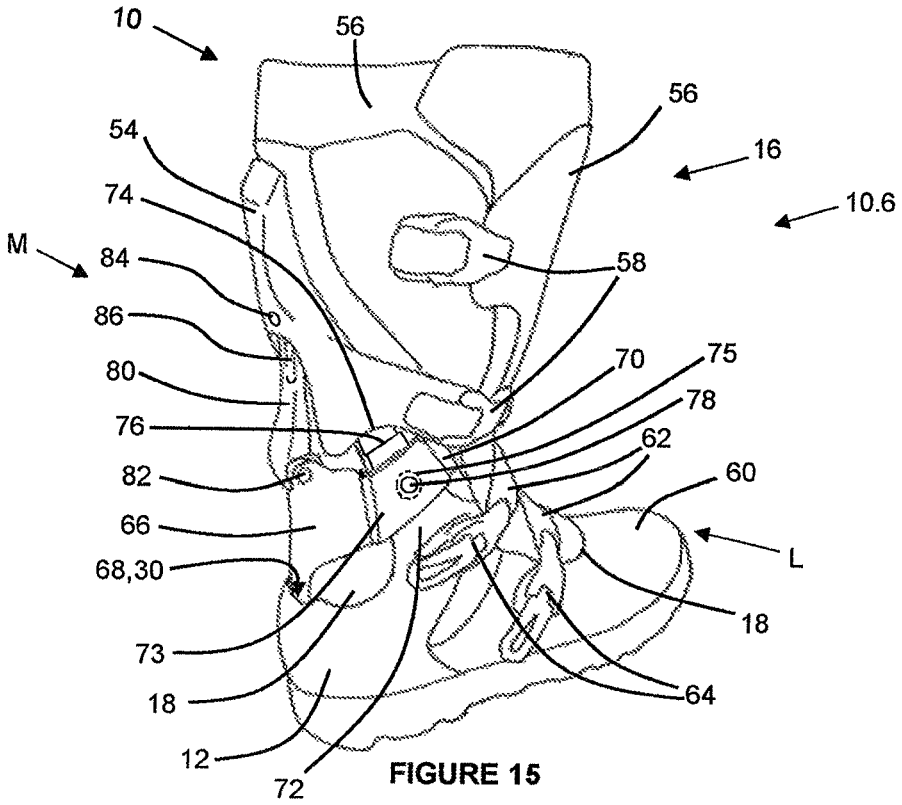
FIG. 15 shows a diagrammatic lateral rear three-dimensional view from above, of the boot of FIG. 14.
Figure 15A:
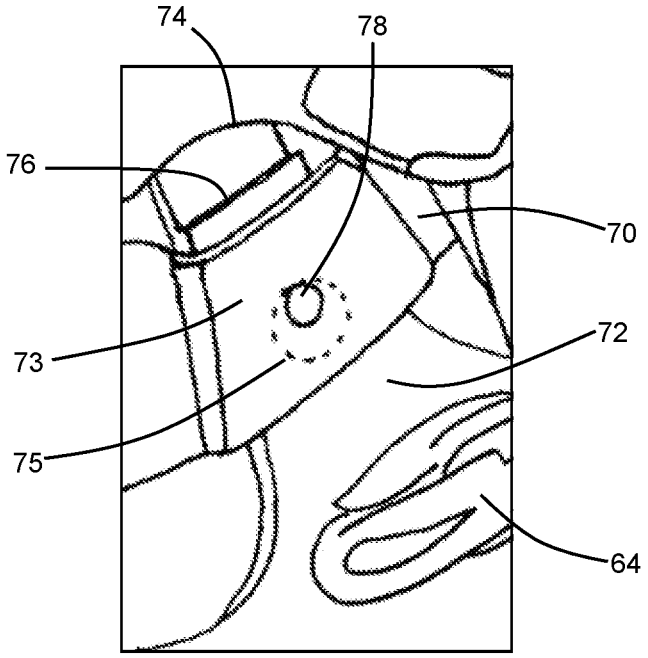
FIG. 15A shows a detail view of the boot of FIG. 15, in a flexed condition.
Figure 16:
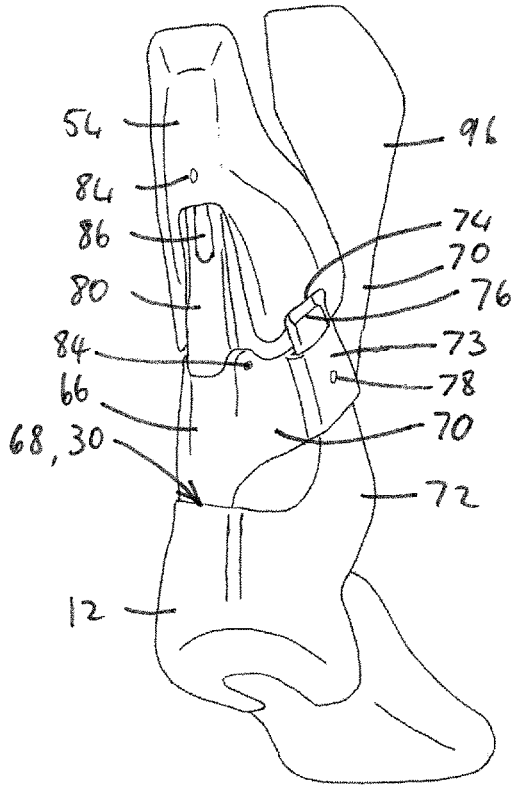
FIG. 16 shows a diagrammatic lateral view from below, of parts of the boot of FIG. 14.

Referring to FIGS. 14 to 16, a sixth embodiment of a boot 10.6 according to the present invention comprises a stiff lower part 12 at the heel of the boot which is preferably attached to the sole 14. The boot 10.6 has a medial side M and a lateral side L that is opposite from the medial side.

A stiff upper part 16 includes a calf element 54 that is attachable to the rear (posterior) of the wearer's upper leg. The upper part 16 also includes a stiff gaiter part 56 that is flexible enough to open at a lateral opening and allow the boot 10.6 to be donned, but the gaiter part is stiff enough to hold the calf element 54 firmly in position relative to the lower leg, when the gaiter element is tightened with gaiter clasps 58. The configuration of the upper part 16 can vary and it can include one or more parts that are more flexible, as long as the main functional components are sufficiently stiff and are attached firmly enough to the lower leg.

The boot 10.6 includes a soft flexible part 18 that extends continuously between the peripheries of the sole 14, the lower part 12, and the gaiter part 56, so that these parts together form a closed boot. The flexible part 18 can include various other elements such as harder protective elements, vents, closures, etc., but in the illustrated embodiment, it includes a tough cover 60 that extends over the top of the toe area and medially to the lower part 12. The flexible part 18 can also open along a medial opening to don the boot 10.6 and two straps 62 extend from the cover 60 and are attachable to the lower part 12 and to a lateral extension of the cover, with lower clasps 64. In addition, limit elements (66,72,80,88) can include a first lateral extension 70 that is configured to extend diagonally upwards from the lower part and is configured to extend generally laterally of the ankle joint on the lateral side L of the item of footwear such as boot 10.6, and a second lateral extension 72 that extends from the lower part about transversely to the first lateral extension on the lateral side L of the item of footwear such as boot 10. 6, the first lateral extension and the second lateral extension both being on the lateral side L of the item of footwear such as boot 10.6. The limit elements (66,72,80,88) can include a pin extending on the lateral side of the item of footwear. In addition, the first lateral extension 70 and the second lateral extension 72 can move relative to each other on the lateral side L of the item of footwear such as boot 10.6, and at least one of the limit elements (66, 72, 80, 88) is stiff and is attachable in at least one location to the upper part 16 or the lower part 12 with an attachment element 84.

The configuration of means for attaching the boot 10 to the wearer's foot can vary greatly and the cover 60, straps 62 and lower clasps 64 are merely an example—as long as the boot includes means for attaching the lower part of the boot to the foot of the wearer and particularly, to hold the lower part 12 firmly in position relative to the wearer's heel.

The cover 60 is relatively stiff and is attached to the lower part 12, but neither the lower part, nor the cover 60 are directly attached to the upper part 16, and the lower part and upper part are connected by the flexible part 18.

The boot 10 includes a combination of limit elements and while the combination of limit elements is preferable, the limit elements can be used separately or in any combination in variations of this embodiment of the invention. The limit elements include a lower element 66 with a heel protuberance 68 that is received in a cavity 30 formed in the lower part 12. The lower end of the heel protuberance 68 is received in the cavity 30 with play and is held captive in the cavity by complementary geometries of the heel protuberance and the cavity. In some embodiments, the complementary geometries can include an anchor pin and aperture, as described above with reference to FIGS. 1 to 3, and/or the complementary geometries can include a widened lower end of the heel protuberance 68 that fits inside the cavity 30 with play, but that is too large to be withdrawn from the cavity. The play between the lower end of the heel protuberance 68 and the cavity 30 allows the lower element 66 to pivot relative to the lower part 12 and to move up and down, but such relative movement between the lower element 66 and the lower part 12 can only occur to a predetermined extent in each direction, before the play is taken up and the relative movement is arrested—as described in more detail with reference to FIGS. 1 to 3.

The lower element 66 includes a first lateral extension 70 that extends about diagonally upwards from the lower element generally laterally of the ankle joint and continues up to a position below one of the gaiter clasps 58, where the first lateral extension 70 is attached to the gaiter part 56. The first lateral extension 70 includes a lateral cover 73 that is not essential and that forms a gap that extends transversely to the first lateral extension.

The boot 10.6 includes a second limit element in the form of a second lateral extension 72 that extends from the lower part 12 in the region of one of the clasps 64, upwards and rearwards, about transversely to the first lateral extension 70, to a lower edge 74 of the calf element 54. At its upper end, the second lateral extension 72 forms a shoulder 76. The second lateral extension 72 preferably extends through the gap formed by the cover 73, but this is not essential. The first and second lateral extensions 70 and 72, respectively, are generally perpendicular and can move relative to each other. However, the relative movement between the first and second lateral extensions can be restricted and in the illustrated embodiment, this is done by way of a pin 78 that extends through the gap under the cover 73 and the pin extends with play, through an aperture 75 defined in the second lateral extension 72. Depending on the degree of stiffness a wearer requires, the second lateral extension 72 could be allowed to move relative to the first lateral extension 70 without restriction, until the play is taken up and further relative movement between the first and second lateral extensions is arrested, or a damping element, such as a flexible washer, can be placed around the pin 78, to reduce play between the pin and the second lateral extension. As also shown in the drawing figures, at least one of the limit elements at least one of the limit elements (66, 72, 80, 88) is stiff and is attachable in at least one location to the upper part 16 or the lower part 12 with an attachment element 84. In addition, at least one of the limit elements (66, 72, 80, 88) is stiff and is attachable in at least one location to the upper part 16 or the lower part 12 with an attachment element 84 with play between the limit element and the attachment element when the ankle is in a neutral condition and the limit element is in its free condition, such as shown in FIGS. 14 and 15. The limit element can extend between a lateral attachment on the lateral side L of the item of footwear such as boot 10.6 in its upper part 16 to a posterior attachment on the lower part 12.

The upper end of the lateral extension 72 is not fixedly attached to the calf element and in the illustrated embodiment, it is received in a sliding manner, below the calf element, with a gap between the edge 74 and the shoulder 76, when the ankle is in a neutral position. The gap between the edge 74 and shoulder 76 allows ankle inversion and eversion without significant interference, while the upper end of the second lateral extension slides relative to the calf element. However, ankle eversion causes the second lateral extension 72 to slide upwards relative to the calf element and causes the gap to close, until a predetermined extent of ankle eversion has occurred and the gap is closed, so that abutment between the shoulder 76 and edge 74 prevents further movement between the second lateral extension 72 and calf element 54 and inhibits further ankle eversion.

The boot 10.6 includes a third limit element in the form of an upper element 80, with a lower end that is pivotally connected to the lower element 66 by a pin 82. An upper end of the upper element 80 is received in a socket defined inside the calf element 54 and a pin 84 is attached to the calf element 54 and extends through the socket and through a longitudinal slot 86. The upper element 80 can slide up and down relative to the calf element, with the pin 84 sliding along the slot 86, but the range of said relative movement is limited by the length of the slot.

During normal use of the boot 10, the lower element 66 and upper element 80 can pivot about the pin 82 and the upper end of the upper element 80 can slide in its socket in the calf element and the heel protuberance 68 and move around inside the cavity 30. These limit elements thus allow sufficient freedom of ankle movement. However, the upper and lower elements 80,66 are longitudinally aligned and under compression, they act as a single limit element to prevent excessive plantar flexion, and under extension, they act as a tensile limit element to prevent excessive dorsiflexion, when the play between the heel protuberance 68 and cavity 30 and the play between the pin 84 and slot 86 have been taken up.

Lastly, the boot 10 includes a medial limit element 88 that extends upwards from the lower part 12, medially of the heel. An upper end of the medial limit element 88 extends into a socket 90 defined medially on the gaiter part 56 and the medial element has a shoulder 92 that is spaced, in normal use, from an edge 94 of the socket. Ankle inversion causes the medial element 88 to slide into the socket 90 and to reduce the gap between the shoulder 92 and the edge 94 and once a predetermined extent of ankle inversion has taken place, the gap is closed and abutment between the shoulder 92 and edge 94 inhibits further ankle inversion.

Figure 17:
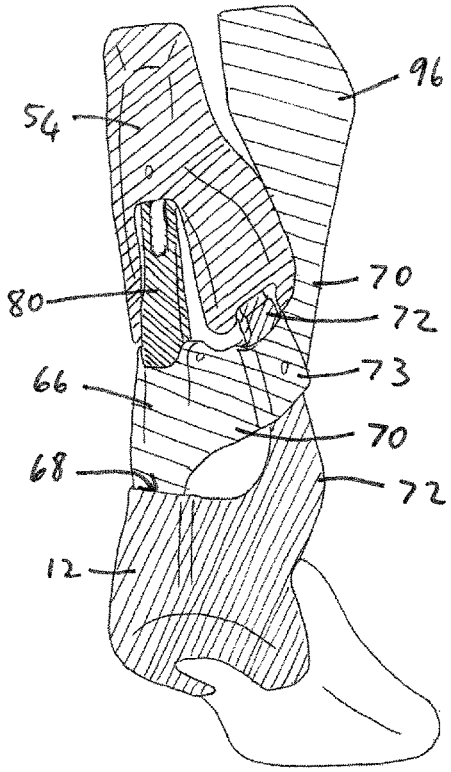
FIG. 17 shows the same view of the same component parts as FIG. 16, with hatching to identify different parts.

FIGS. 16 and 17 show functional parts (comprising largely of limit elements) of the boot 10. What is shown more clearly in these Figures, is the structural continuity from the first lateral extension 70 to the gaiter part 56, which is by way of a lateral calf element 96 that forms part of the gaiter part 56 and that is contiguous with the first lateral extension 70, diagonally, laterally of the ankle joint.

The invention claimed is:

1. An item of footwear comprising:

a stiff lower part that is configured to extend at least in part around a foot of a wearer, below an ankle joint, said lower part being attached to a sole;

a stiff upper part that is configured to extend at least in part around a lower leg of the wearer, above the ankle joint; said upper part including a calf element that is attachable to a rear portion of a wearer's leg, and a gaiter part that is flexible enough to open at a lateral opening and allow the item of footwear to be donned and stiff enough to hold the calf element in position relative to the lower leg of the wearer;

a flexible part extending continuously between peripheries of the sole, the lower part, and the gaiter part so that said flexible part, said sole, said lower part, and said gaiter part together can close the item of footwear on the wearer; and at least two limit elements that each extend between the lower part and the upper part;

said lower part and upper part being movable relative to each other;

wherein said relative movement between the lower part and the upper part is inhibited selectively by the limit elements, each of said limit elements being displaceable between a free condition in which the lower part and the upper part are movable relative to each other, and a locked condition in which the relative movement between the lower part and the upper part is inhibited in at least the direction in which the limit element is displaced from its free condition to its locked condition;

wherein said item of footwear has a medial side and a lateral side that is opposite from the medial side;

wherein said limit elements include a first lateral extension that is configured to extend diagonally upwards from the lower part and is configured to extend generally laterally of the ankle joint on the lateral side of the item of footwear, and a second lateral extension that extends from the lower part about transversely to the first lateral extension on the lateral side of the item of footwear, the first lateral extension and the second lateral extension both being on the lateral side of the item of footwear;

wherein said limit elements include a pin extending on the lateral side of the item of footwear, from the first lateral extension through an aperture defined in the second lateral extension;

wherein the first lateral extension and the second lateral extension are movable relative to each other on the lateral side of the item of footwear when the limit elements are in the free condition, and wherein said relative movement between the first lateral extension and the second lateral extension is arrested by the pin when the limit elements are in the locked condition.

2. The item of footwear according to claim 1, wherein at least one of the limit elements is stiff and is attachable in at least one location to the upper part or the lower part with an attachment element, so that when the ankle is in a neutral condition, the limit element is in its free condition, and the limit element is in a locked condition when the wearer's ankle is moved from the neutral condition to a predetermined extent.

3. The item of footwear according to claim 2, wherein the limit element extends between a lateral attachment on the lateral side of the upper part and a posterior attachment on the lower part.

4. The item of footwear according to claim 2, wherein the limit element extends posteriorly between a posterior attachment on the upper part and a posterior attachment on the lower part.

5. The item of footwear according to claim 4, wherein the limit element is a composite limit element comprising two limit elements that are pivotally jointed.

6. The item of footwear according to claim 1, wherein at least one of the limit elements is stiff and is attachable in at least one location to the upper part or the lower part with an attachment element, with play between the limit element and the attachment element when the ankle is in a neutral condition and the limit element is in its free condition, said play being taken up and the limit element being in a locked condition when the wearer's ankle is moved from the neutral condition to a predetermined extent.

7. The item of footwear according to claim 6, wherein the limit element extends between a lateral attachment on a lateral side of the upper part and a posterior attachment on the lower part.

8. The item of footwear according to claim 6, wherein the limit element extends posteriorly between a posterior attachment on the upper part and a posterior attachment on the lower part.

9. The item of footwear according to claim 8, wherein the limit element is a composite limit element comprising two limit elements that are pivotally jointed.

10. The item of footwear according to claim 1, wherein the gaiter part is tightened with a gaiter clasp.

11. The item of footwear according to claim 1, wherein the flexible part includes a cover that extends over top of a toe area and medially to the lower part.

* * * * *